US005947205A

United States Patent [19]

Shy

[11] Patent Number: 5,947,205

[45] **Date of Patent: *Sep. 7, 1999**

[54] LINEAR INDEXING APPARATUS WITH SELECTIVE PORTING

[75] Inventor: Perry C. Shy, Southlake, Tex.

[73] Assignee: Halliburton Energy Services, Inc., Dallas, Tex.

[ * ] Notice: This patent is subject to a terminal disclaimer.

[21] Appl. No.: 08/787,341

[22] Filed: Jan. 28, 1997

Related U.S. Application Data

[63] Continuation-in-part of application No. 08/667,305, Jun. 20, 1996.

[51] Int. Cl.[6] ..... E21B 33/00

[52] U.S. Cl. ..... 166/319; 166/334.4

[58] Field of Search ..... 166/319, 323, 166/332.1, 332.4, 332.6, 334.1, 334.4

[56] References Cited

U.S. PATENT DOCUMENTS

| | | | |
|---|---|---|---|
| 3,362,476 | 1/1968 | Van Poollen | 166/21 |
| 3,861,467 | 1/1975 | Harnsberger | 166/276 |
| 4,154,303 | 5/1979 | Fournier | 166/317 |
| 4,160,484 | 7/1979 | Watkins | 166/317 |
| 4,186,803 | 2/1980 | Mondshine | 166/292 |
| 4,216,830 | 8/1980 | Fredd | 166/319 |
| 4,374,543 | 2/1983 | Richardson | 166/192 |
| 4,378,049 | 3/1983 | Hsu et al. | 166/295 |
| 4,423,773 | 1/1984 | Stout | 166/317 |
| 4,428,427 | 1/1984 | Friedman | 166/278 |
| 4,433,702 | 2/1984 | Baker | 137/527.6 |
| 4,541,484 | 9/1985 | Salerni et al. | 166/278 |
| 4,597,445 | 7/1986 | Knox | 166/319 |
| 4,691,775 | 9/1987 | Lustig et al. | 166/317 |
| 4,721,159 | 1/1988 | Ohkochi et al. | 166/286 |
| 4,813,481 | 3/1989 | Sproul et al. | 166/51 |
| 4,817,720 | 4/1989 | Friedman et al. | 166/295 |
| 4,888,240 | 12/1989 | Graham et al. | 428/403 |
| 4,898,750 | 2/1990 | Friedman et al. | 427/221 |
| 5,181,569 | 1/1993 | McCoy et al. | 166/317 |
| 5,188,182 | 2/1993 | Echols, III et al. | 166/376 |
| 5,188,183 | 2/1993 | Hopmann et al. | 166/387 |
| 5,253,706 | 10/1993 | Reid | 166/135 |
| 5,404,956 | 4/1995 | Bohlen et al. | 166/387 |
| 5,417,285 | 5/1995 | Van Buskirk et al. | 166/292 |
| 5,441,111 | 8/1995 | Whiteford | 166/387 |
| 5,479,986 | 1/1996 | Gano, et al. | 166/292 |

OTHER PUBLICATIONS

Omega 2.1" Unibalance Pressure Cycle Plug; information sheets; 6 pgs.; 1995.

*Primary Examiner*—William Neuder
*Attorney, Agent, or Firm*—Paul I. Herman; William M. Imwalle; J. Richard Konneker

[57] ABSTRACT

A linear indexing tool is operably supportable on a tubing string in a subterranean wellbore and has a tubular housing structure within which a tubular mandrel is coaxially and slidably disposed. An indexing structure is operable by tubing pressure to sequentially drive the mandrel through a plurality of axial travel increments in response to a corresponding successive plurality of tubing pressure forces exerted on the indexing structure. Pressure diversion apparatus is operative to permit flow of pressurized fluid from within the housing structure to an external, pressure-actuatable device, such as a packer, only after the mandrel has been driven through at least two of its axial travel increments. Accordingly, the internal tubing pressure may be elevated to a test level thereof, thereby driving the mandrel through its first axial travel increment, without actuating the external device. A subsequent tubing pressure reduction and re-elevation may then be used to index the mandrel through another axial travel stroke to cause the internal tubing pressure to be operably diverted to the external device.

29 Claims, 5 Drawing Sheets

LINEAR INDEXING APPARATUS WITH SELECTIVE PORTING

CROSS-REFERENCE TO RELATED APPLICATION

This application is a continuation-in-part of copending U.S. patent application Ser. No. 08/667,305 filed on Jun. 20, 1996 and entitled "LINEAR INDEXING APPARATUS AND METHODS OF USING SAME", such copending application being hereby incorporated by reference herein.

BACKGROUND OF THE INVENTION

The present invention generally relates to tools used in subterranean wells and, in a preferred embodiment thereof, more particularly provides a linear indexing tool in which pressurized fluid in the interior of the tool is automatically diverted to an exterior pressure actuatable device in response the completion of a predetermined number of indexing cycles of the tool.

Due to their very nature, subterranean wells are typically axially elongated, with their axial lengths being orders of magnitude greater than their diameters. Where such tools are remotely positioned in subterranean wells, only a limited number of actions may be taken at the earth's surface to control operation of the tools such as setting a packer within a wellbore. One of these actions is to create a controllably increased fluid pressure within the interior of the tubing string with which a particular tool is in operative fluid communication. Thus, for example, to use internal tubing pressure to hydraulically set a packer externally supported on the tubing string it is necessary to force pressurized fluid downwardly through the tubing string and then operatively apply the created fluid pressure to the particular mechanism which is used to set the packer.

Before the packer is set, however, it is desirable to apply an internal test pressure to the tubing string to verify the absence of leaks therein and/or use the internal tubing pressure to operate other pressure actuatable devices carried by the tubing string. The problem is, of course, that in conventional designs creation of this elevated fluid pressure within the tubing string sets the packer. If a tubing string leak is subsequently discovered, the completion cannot be pulled up due to the setting of the packer.

A design goal when hydraulically set packers (or other external pressure actuatable devices) are utilized has thus been to be able to create a full test pressure within the tubing string without actuating the packer or other external device, and then utilize internal tubing pressure to actuate the packer or other external device subsequent to a successful tubing pressure test.

One previously proposed solution to this problem has been to provide within the tubing string an explosive charge which, when set off, opens a port that permits pressurized fluid within the tubing string to be discharged therefrom and bypassed to the inlet of a packer setting structure. During pressure testing of the tubing string the port is blocked by a shiftable member within the interior of the string. After a successful tubing pressure test, a predetermined pressure pulse sequence is created in the tubing and detected by an electronic transducer therein. Upon detecting the predetermined pressure pulse sequence the transducer transmits an electrical output signal that detonates the charge. The resulting detonation force is used to forcible move the shiftable member to unblock the port and thereby permit internal tubing pressure to flow out of the tubing string and set the packer.

This previously proposed solution carries with it several problems, limitations and disadvantages. For example, the use of the electronic transducer is undesirably complex and relatively expensive. Additionally, the system can fail in several ways such as transducer failure, total detonation failure, or inoperably low detonation force. Moreover, this conventional detonation-based tubing pressure diversion system can be used only once—i.e., after an initial tubing pressure diversion to an external packer or other external pressure actuatable device the diversion apparatus cannot be used again in the well completion.

In view of the foregoing it can be readily seen that it would be highly desirable to provide improved tubing pressure diversion apparatus and associated methods which permit the internal tubing pressure to be elevated to a test pressure, prior to tubing pressure actuation of a packer or other external device, without the problems, limitations and disadvantages associated with conventional apparatus and methods such as those described above. It is accordingly an object of the present invention to provide such improved tubing pressure diversion apparatus and methods.

SUMMARY OF THE INVENTION

In carrying out principles of the present invention, in accordance with a preferred embodiment thereof, a subterranean wellbore tool is provided which is connectable in a tubing string and is used to selectively permit an outflow of internal pressurized fluid through a side wall portion thereof, after the tubing string is pressure tested, for diversion to and operation of an external pressure-actuatable device such as a packer. Due to a unique internal indexing action of the tool, a first increase in the fluid pressure differential between the interior and exterior of the tool may be used to conduct the tubing string internal pressure test, while a subsequent increase in such pressure differential automatically flows pressurized fluid from within the tool to the external pressure-actuatable device.

From a broad perspective the subterranean wellbore tool comprises a tubular outer structure in which a control member is movably supported. Indexing structure is associated with the control member and is operative to sequentially drive it through a plurality of predetermined separate travel increments relative to the outer structure in response to a corresponding successive plurality of increases in the pressure differential between the interior and exterior of the outer structure. The tool also includes pressure diversion apparatus operative to permit flow of pressurized fluid within the outer structure outwardly through a side wall portion thereof only after the control member has been driven at least partially through its second or subsequent travel increment.

In a preferred embodiment of the tool the control member is a tubular mandrel coaxially and slidably supported within the tubular outer structure, and the travel increments of the tubular mandrel are axially directed relative to the tubular outer structure.

According to a feature of the invention, the pressure diversion apparatus includes (1) a passage extending outwardly through the outer structure side wall portion, (2) a frangible hollow plug structure sealingly received in the passage and preventing fluid flow therethrough, the plug structure having an inner end section which projects into the interior of the outer structure and, when broken, permits fluid flow outwardly through the passage, and (3) an axially extending side wall depression, representatively an external side surface groove, formed in the mandrel and slidably receiving the inner plug structure end section, the depression having an end surface positioned to forcibly engage and break the inner plug structure end section when the mandrel has been axially driven at least partially through its second or subsequent travel increment.

The fluid outlet passage formed in the tool representatively includes a sidewall port, and an outlet portion extending generally transversely to the port. Additionally, the plug structure includes a hollow first plug portion sealingly received in a radially inner portion of the port and having a sealed radially inner end portion defining the inner plug structure end section, and an open radially outer end, and a second plug portion received in a radially outer portion of thee port and having an inner end bearing against the outer end of the first plug portion and retaining the first plug portion sealingly within the radially inner portion of the port, the second plug portion having an opening therein through which the interior of the first plug portion communicates with the passage outlet portion.

In an alternate embodiment of the pressure diversion apparatus, such apparatus includes a fluid outlet passage formed in the outer structure side wall portion and having an inlet opening on the interior side surface of the outer structure in opposition to an exterior side surface portion of the mandrel, and a seal structure operative to prevent pressurized fluid outflow through the passage until the mandrel has been axially driven at least partially through its second or subsequent travel increment. The seal structure preferably includes a pair of resilient O-ring seal members carried on the inner side of the outer structure on axially opposite sides of the inlet opening of the fluid outlet passage.

The tool is representatively used by connecting it into a tubing string which is lowered into a wellbore to a predetermined depth therein. The fluid pressure level within the tubing string is elevated to a test level to check for leaks therein. This first internal pressure increase causes the indexing structure to axially move the mandrel through its first travel increment without unblocking the tool's side wall outlet passage. Accordingly, the exterior device to which internal tubing string pressurized may be diverted is not actuated by the pressure test.

If no tubing string leaks are detected, the internal fluid pressure within the tubing string is lowered and then increased again to cause the indexing structure to axially index the mandrel through its second travel increment. The axial indexing strokes of the mandrel may be used to mechanically operate another portion of the well completion, such as by operatively engaging a disappearing plug as illustrated and described in the aforementioned copending U.S. application Ser. No. 08/667,305, or simply to divert pressurized fluid from within the tubing string to the external pressure-actuatable device on the second or subsequent axial indexing stroke of the mandrel directly created by fluid pressure within the tubing string.

The axial, tubing pressure-created indexing of the mandrel which diverts pressurized fluid to the external tool only in response to a second or subsequent travel increment of the mandrel provides, in a relatively simple and inexpensive fashion, for reliable operation of the external device without actuating such device during a pressure test of the tubing string.

In an alternate embodiment of the tool, spaced apart first and second fluid outlet passages are formed in the tool's tubular outer structure, and the pressure diversion apparatus is operative to permit flow of pressurized fluid within the outer structure outwardly through the first and second fluid outlet passages only after the control member has been driven at least partially through at least one travel increment subsequent to its first travel increment. This feature of the invention permits two external pressure-actuatable devices to be operated, either simultaneously or sequentially depending on the configuration of the pressure diversion apparatus, with pressurized internal tubing string fluid after the tubing string has been pressure tested.

Representatively, this control of two external pressure-actuatable devices is achieved using two circumferentially spaced fluid outlet passages formed in the tubular outer structure side wall portion, with each outlet passage receiving one of the aforementioned frangible plug structures. A corresponding circumferentially spaced pair of mandrel exterior side surface grooves slidably receive the breakaway inner ends of the plug structures. By appropriately orienting the axial locations of the plug structures and/or the groove end surfaces that engage and break the plug structures, the fluid outlet passages may be simultaneously or sequentially opened as desired during tubing pressure-created axial indexing of the mandrel subsequent to its first axial travel increment. As will be readily appreciated, more than two external devices can be controlled in this manner simply by adding more plug structures or other alternate portions of the pressure diversion apparatus such as the aforementioned seal structures.

DETAILED DESCRIPTION

Figure 1:
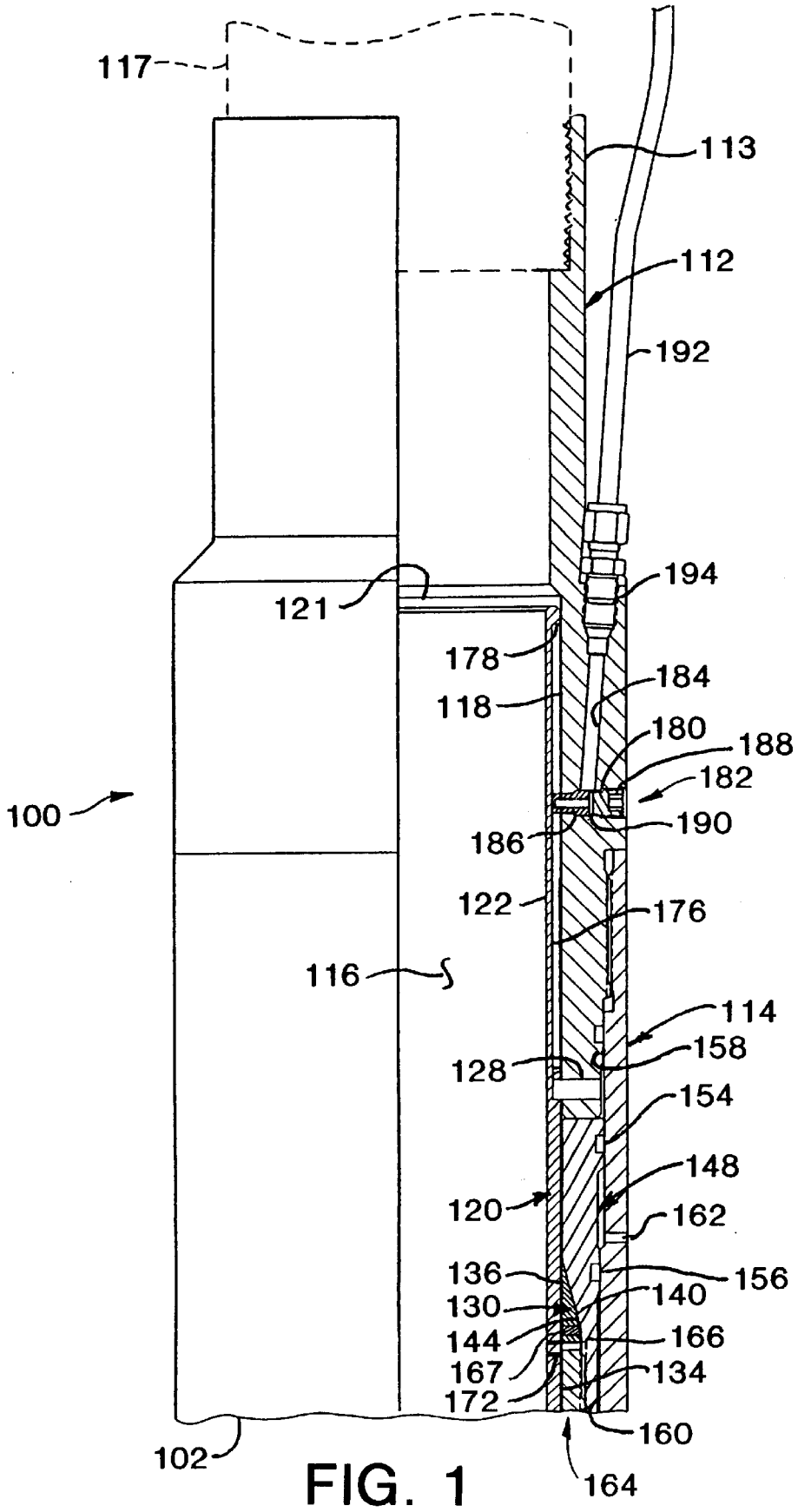
FIGS. 1 and 2 are quarter-sectional views of downwardly successive axial portions of a linear indexing apparatus embodying principles of the present invention, the apparatus being shown in a configuration in which it is run into a subterranean well.
Figure 2:
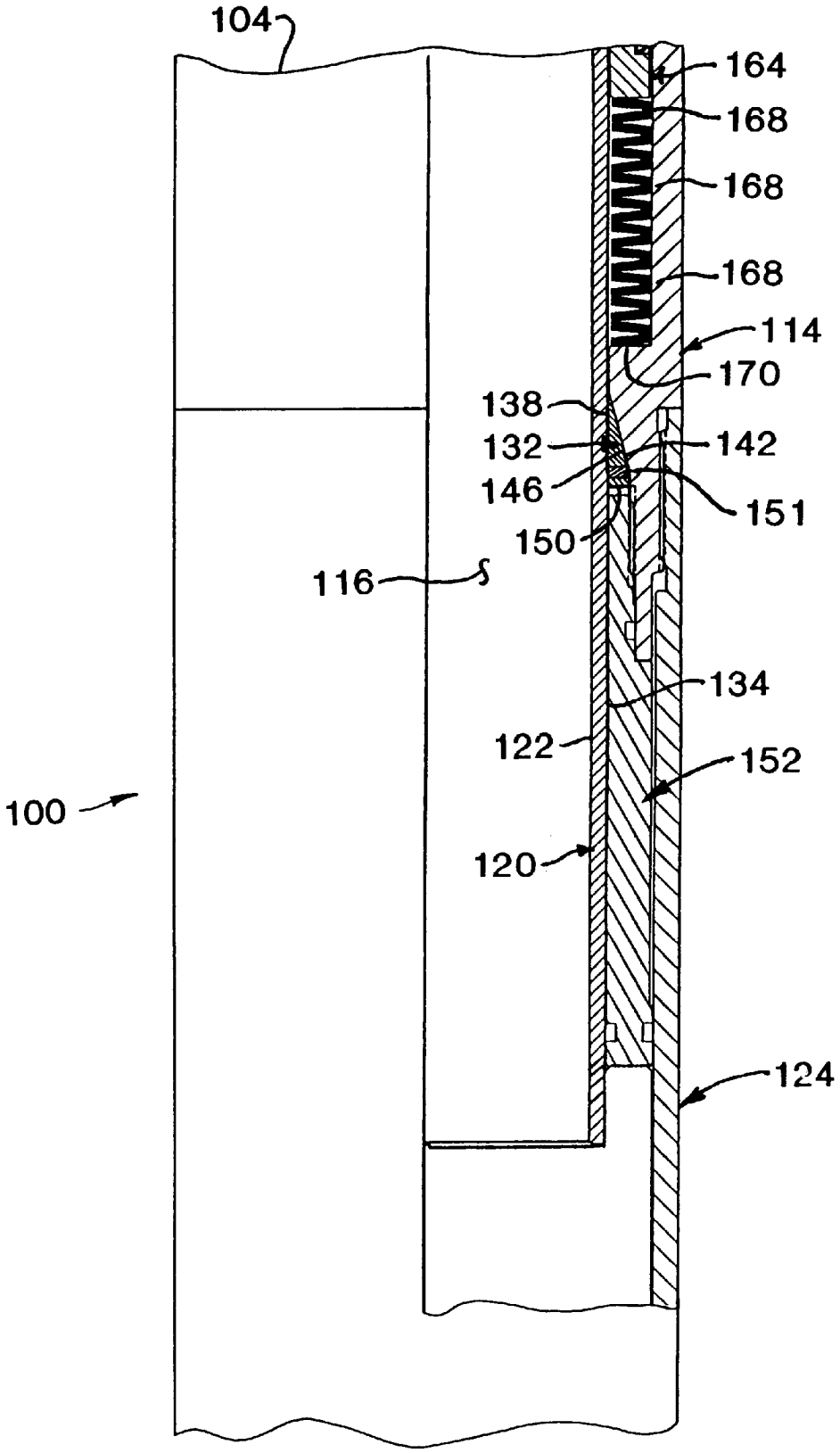

Illustrated in FIGS. 1 and 2 are downwardly successive longitudinal portions of a specially designed linear indexing apparatus 100 embodying principles of the present invention. Apparatus 100 has an elongated, generally tubular configuration, and is shown in a configuration thereof in which it is run into a subterranean well.

In the following detailed description of various embodiments of the present invention representatively illustrated in the accompanying figures, directional terms, such as "upper", "lower", "upward", "downward", etc., are used in relation to the representatively vertical orientation of the illustrated embodiments of apparatus 100 as they are depicted in the accompanying figures. It is to be understood, however, that the apparatus 100 may be utilized in vertical, horizontal, inverted, or inclined orientations without deviating from the principles of the present invention.

For convenience of illustration, FIGS. 1 and 2 show the apparatus 100 in successive axial portions, but it is to be understood that the apparatus is a continuous assembly, the lower end 102 of the upper apparatus portion shown in FIG.

1 being continuous with upper end 104 of the lower apparatus portion shown in FIG. 2.

In the linear indexing apparatus or tool 100 a generally tubular upper adapter 112 is threadedly and sealingly attached to a generally tubular housing 114 of the apparatus 100. An axial flow passage 116 extends through the apparatus 100. An upper end portion 113 of adapter 112 is internally threaded to permit the apparatus 100 to be connected to and suspended from a tubing string 117 (shown in phantom in FIG. 1) within a subterranean well, and further permit fluid communication between the interior of the tubing string 117 and the axial flow passage 116.

The upper adapter 112 has an axially extending internal bore 118 formed thereon, in which a control member in the form of a generally tubular mandrel 120, having a top end 121, is axially and slidingly received. The axial flow passage 116 extends axially through an internal bore 122 formed on the mandrel 120.

At its lower end the tubular housing 114 is threadedly and sealingly attached to a generally tubular lower adapter 124. The lower adapter 124 extends axially downwardly from the lower end of the housing 114. At a lower end portion thereof (not shown), the lower adapter 124 may be threadedly and sealingly attached to tubing, other tools, etc. below the apparatus 100. For this purpose, such lower end portion may be internally or externally threaded, provided with seals, etc.

The mandrel 120 is releasably secured against axially upward or downward displacement relative to the upper and lower adapters 114, 124 by a shear pin 128 installed radially through the upper adapter 112 and into the mandrel 120. Upper and lower slips 130, 132, respectively, are radially outwardly disposed relative to an outer side surface 134 of the mandrel 120. The slips 130, 132 are generally wedge-shaped and each slip has a toothed inner side surface 136, 138, respectively, which grippingly engages the mandrel outer side surface 134 when a radially sloped and axially extending surface 140, 142, respectively, formed on each of the slips axially engage corresponding and complementarily shaped surfaces 144, 146, respectively, internally formed on the upper housing 114 and a generally tubular piston 148 disposed radially between the upper housing 114 and the mandrel 120.

Each of the slips 130, 132 is preferably comprised of circumferentially distributed individual segments, only one of which is visible in FIGS. 1 and 2. Such wedge-shaped slip segments are well known to those of ordinary skill in the art. However, it is to be understood that other means may be provided for preventing axially upward displacement of the mandrel 120 without departing from the principles of the present invention.

The mandrel outer side surface 134 preferably has a toothed or serrated profile formed on a portion thereof where the slips 130, 132 may grippingly engage the outer side surface 134 to enhance the gripping engagement therebetween, but it is to be understood that such toothed or serrated profile is not required in a linear indexing apparatus 100 embodying principles of the present invention. It is also to be understood that other means may be provided for grippingly engaging the mandrel 120 without departing from the principles of the present invention.

The lower slip 132 prevents axially upward displacement of the mandrel 120 relative to the housing 114 at any time. If an axially upwardly directed force is applied to the mandrel 120, tending to upwardly displace the mandrel, gripping engagement between the lower slip 132 and the mandrel outer side surface 134 will force the sloped surface 142 of the slip 132 into axial engagement with the sloped surface 146 of the housing 114, thereby radially inwardly biasing the slip 132 to increasingly grippingly engage the mandrel outer side surface 134, preventing axial displacement of the mandrel relative to the slip 132.

Initial minimal gripping engagement between the slip 132 and the mandrel outer side surface 134 is provided by a circumferential wavy spring washer 150 disposed axially between the slip 132 and a generally tubular retainer 152 internally threadedly and sealingly attached to the housing 114. A flat washer 151 transmits a compressive force from the wavy spring washer 150 to the circumferentially distributed segments of slip 132. The initial gripping engagement between the slip 132 and the mandrel outer side surface 134 is not sufficient to prevent axially downward displacement of the mandrel 120 relative to the upper housing 114, as described in further detail hereinbelow.

The piston 148 is axially slidably disposed within the housing 114 and has two axially spaced apart circumferential seals 154, 156 externally disposed thereon. Each of the seals 154, 156 sealingly engages one of two axially extending bores 158, 160, respectively, internally formed on the housing 114. A radially extending port 162 formed through the housing 114 provides fluid communication between the exterior of the linear indexing apparatus 100 and that outer portion of the piston 148 axially between the seals 154, 156.

The upper bore 158 is radially enlarged relative to the lower bore 160, thus forming a differential area therebetween. The piston 148 is otherwise in fluid communication with the axial flow passage 116. Therefore, if fluid pressure in the axial flow passage 116 exceeds fluid pressure external to the apparatus 100, the piston 148 is biased axially downward by a force approximately equal to the difference in the fluid pressures multiplied by the differential area between the bores 158, 160. Similarly, if fluid pressure external to the apparatus 100 is greater than fluid pressure in the axial flow passage 116, the piston 148 is thereby biased axially upward by a force approximately equal to the difference in the fluid pressures multiplied by the differential area between the bores 158, 160.

Piston 148 is prevented from displacing axially upward relative to the upper housing 114 by axial contact between the upper end of the piston and the lower end of the upper adapter 112. The piston 148 may, however, be axially downwardly displaced relative to the tubular housing 114 by applying a fluid pressure to the axial flow passage 116 which exceeds fluid pressure external to the apparatus 100 by a predetermined amount. The amount of the difference in the fluid pressures required to axially downwardly displace the piston 148 is described in greater detail hereinbelow.

A generally tubular retainer 164 is threadedly attached to the piston 148 and extends axially downward therefrom. The slip 130 and a circumferential wavy spring washer 166 are axially retained between the sloped surface 144 on the piston 148 and the retainer 164. The washer 166 maintains a preload on the slip 130, so that the slip 130 minimally grippingly engages the mandrel outer side surface 134. A flat washer 167 transmits the preload from the wavy spring washer 166 to the circumferentially distributed segments of the slip 130.

When the piston 148 is axially downwardly displaced relative to the housing 114, the gripping engagement of the slip 130 with the mandrel outer side surface 134 forces the slip 130 into axial engagement with the sloped surface 144 on the piston 148, thereby radially inwardly biasing the slip 130. Such radially inward biasing of the slip 130 causes the slip to increasingly grippingly engage the mandrel outer side surface 134, forcing the mandrel 120 to axially downwardly displace along with the piston 148. Thus, the increased gripping engagement between the slip 130 and the mandrel outer side surface 134 caused by axially downward displacement of the piston 148 also causes the mandrel 120 to displace along with the piston, and enables the axially downward displacement of the mandrel 120 to be metered by the displacement of the piston. Therefore, the mandrel 120 may be incrementally indexed axially downwardly, with each increment being equal to a corresponding axially downward displacement of the piston 148.

The piston 148 is biased axially upward by an axially stacked series of bellville spring washers 168. The spring washers 168 are installed axially between the retainer 164 and a radially inwardly extending shoulder 170 internally formed on the housing 114, and radially between the housing 114 and the mandrel 120. Spring washers 168 axially upwardly bias the piston 148 such that it axially contacts the lower end of the upper adapter 112. A radially extending port 172 formed through the mandrel 120 permits fluid communication between the axial flow passage 116 and the spring washers 168, retainer 164, piston 148, etc.

In operation, the apparatus 100 may be suspended from the tubing string 117, as hereinabove described, and positioned within a subterranean well. An annulus is thus formed radially between the apparatus 100 and tubing string 117, and the bore of the well. With the axial flow passage 116 in fluid communication with the interior of the tubing string extending to the earth's surface, and sealingly isolated from the annulus, a positive pressure differential may be created from the axial flow passage to the annulus by, for example, applying pressure to the interior of the tubing 117 at the earth's surface, or reducing pressure in the annulus at the earth's surface. It is to be understood that the pressure differential may be created in other manners without departing from the principles of the present invention.

In order for the pressure differential to cause axially downward displacement of the piston 148 relative to the housing 114, the downwardly directed biasing force resulting from the pressure differential being applied to the differential piston area between the bores 158 and 160 must exceed the sum of at least three forces: 1) the axially upwardly biasing force of the spring washers 168; 2) a force required to shear the shear pin 128 to thereby initially free the mandrel 120 from the upper adapter 112; and 3) a force required to overcome the minimal gripping engagement of the slip 132 with the mandrel outer surface 134. When the sum of these forces is exceeded by the downwardly biasing force resulting from the pressure differential, the shear pin 128 will be sheared and the piston 148, slip 130, wavy spring 166, washer 167, retainer 164, and mandrel 120 will displace axially downward relative to the upper housing 114.

The internal tubing pressure-actuated linear indexing structure just described is representative only, and may be replaced with structures having various alternate constructions, such as those illustrated and described in the aforementioned copending U.S. application Ser. No. 08/667,305, to downwardly index the mandrel 120 through a successive plurality of predetermined axial travel increments in response to a corresponding successive plurality of changes in the pressure differential between the interior and exterior of the tubing.

The successive downward axial index strokes of the mandrel 120, directly powered by internal tubing pressure as the interior-to-exterior tubing pressure differential is alternately and repetitively increased and decreased, may be used to operate and manipulate a variety of tools (not shown) and devices disposed beneath the apparatus 100 in the tubing string such as, for example, a ball catcher sub seat, a valve, an explosive charge, and a plug.

In addition to directly utilizing internal tubing pressure to actuate these and other types of tools within the tubing string, it may be desired to also use internal tubing string pressure to activate external tools, such as packers, by diverting internal tubing string pressure to the exterior of the string to actuate the particular external device. In the past this has created a problem since it is typically desirable to pressure test the tubing before using its internal pressure to set the packer. More specifically, in the past the elevation of the tubing internal pressure to a test level also set the packer. If no tubing string leaks were discovered after the packer was set, this packer setting method was satisfactory. However, if such leaks were present, the completion could not be pulled up because of the unavoidable setting of the packer concurrently with the tubing string pressure testing.

In the present invention this problem is uniquely solved by utilizing the axial indexing of the mandrel 120 to permit, during a first indexing movement of the mandrel, the external pressure-actuatable device to be isolated from the internal tubing string pressure, and then operably communicate the internal tubing string pressure with the external device in response to a subsequent indexing movement of the mandrel 120. This desirable result is achieved using a specially designed pressure diversion apparatus which includes the indexing structure-driven mandrel 120 and which will now be described with initial reference to FIG. 1.

Turning now to FIG. 1, the pressure diversion apparatus includes an axially extending groove 176 formed in the outer side surface of the mandrel 120 and having an upper end surface 178; a side wall port 180 formed in the upper adapter 112 and transversely extending between its inner and outer side surfaces; and a generally cylindrical isolation plug structure 182 operatively received in the port 180. For purposes later described, a generally axially extending fluid flow passage 184 is formed in the upper adapter 112 above the port 180 and has a lower end communicated with the port 180, and an upper end portion opening outwardly through the upper adapter 112.

The generally cylindrical plug structure 182 includes a hollow, frangible metal radially inner portion 186 sealingly received in a corresponding radially inner portion of the port 180. As indicated, plug portion 186 has a closed inner end section slidingly received in the mandrel groove 176, and an open radially outer end. Plug structure 182 also includes a separate, socketed metal outer end portion 188 which is threaded into a radially outer portion of the port 180 and bears at its inner end against the open outer end of the plug portion 186 to sealingly retain it in the indicated inner end portion of the port 180.

A transverse slot 190 is formed in the inner end of the outer plug portion 188. With the apparatus 100 in its run-in orientation indicated in FIG. 1, the interior of the hollow frangible inner plug portion 186 communicates with the generally axially extending adapter passage 184 through the slot 190. A fluid control line 192 external to the upper adapter 112 is communicated at its lower end with the adapter passage 184 by a tubular fitting 194 threaded into an upper end portion of the passage 184. The upper end of the control line 192 is operatively connected to an external, pressure actuatable tool or device (not shown) such as, for example, a packer.

Figure 1C:
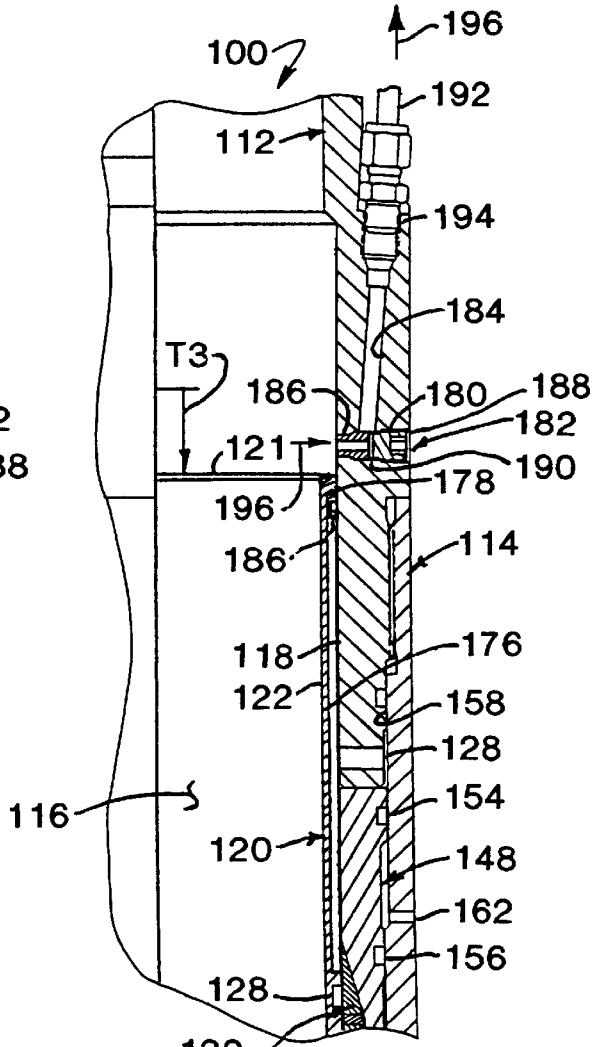
FIGS. 1A–1C are partial quarter sectional views of the upper portion of the apparatus shown in FIG. 1 and sequentially illustrate the indexing and selective outlet pressure porting operations of the apparatus.

Turning to FIGS. 1–1C, as will now be described, the pressure diversion portion of the apparatus 100 is representatively configured to isolate the external pressure-actuatable device from pressurized fluid within the tubing string, by preventing outward flow of pressurized fluid through port 180, until the mandrel 120 has been downwardly indexed through at least two axial travel increments thereof. Representatively, in the apparatus 100 this isolation of internal tubing string fluid pressure from the external pressure-actuatable tool or device is maintained until the mandrel is moved through three such axial travel increments.

Figure 1B:
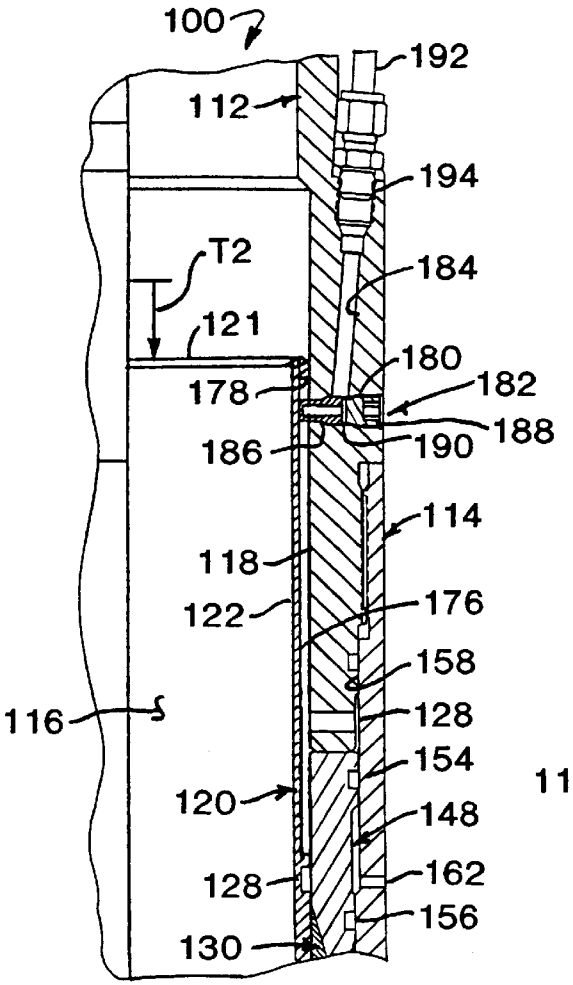
Figure 1A:
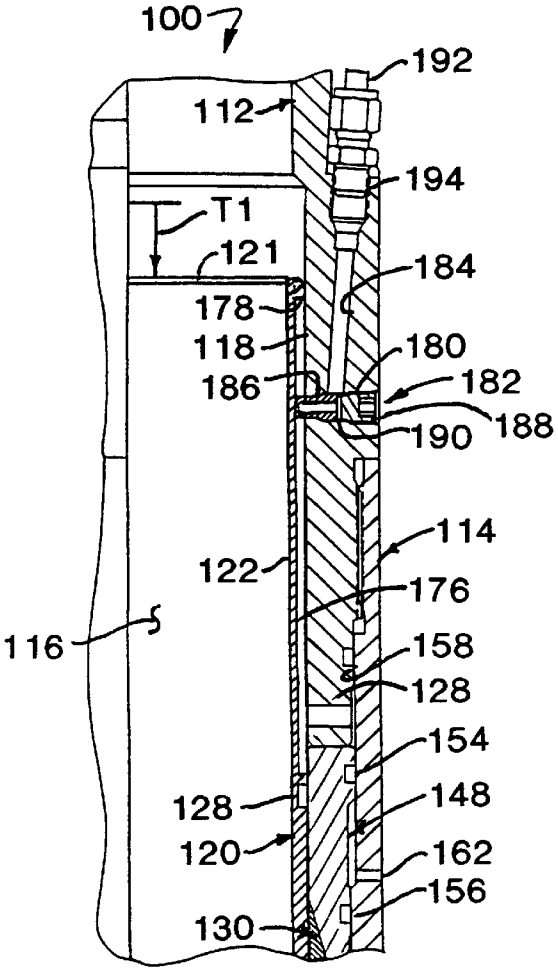

Specifically, after the apparatus 100 is run into the well in its FIG. 1 orientation, the fluid pressure within the tubing string 117 is increased to a test level thereof sufficient to cause the previously described indexing apparatus to cause the shear pin 128 to break (see FIG. 1A) and downwardly move the mandrel 120 through a first axial travel increment as indicated by the arrow T1 in FIG. 1A. At this point, the mandrel groove end surface 178 is still above the inner plug portion 186 which prevents pressurized fluid within the tubing string 117 from flowing outwardly through the port 180 and passage 184 and setting the packer.

Next, the fluid pressure in the tubing string 117 is reduced, to permit the indexing apparatus to reset itself as previously described herein, and is then increased to a level sufficient to axially drive the mandrel 120 downwardly through a second axial travel increment as indicated by the arrow T2 in FIG. 1B. After the mandrel 120 finishes its second axial indexing stroke T2 the mandrel groove end surface 178 is still above the inner plug portion 186 which continues to prevent pressurized fluid within the tubing string 117 from flowing outwardly through the port 180 and passage 184 and setting the packer.

Finally, the fluid pressure in the tubing string 117 is reduced, to permit the indexing apparatus to reset itself a second time, and is then increased to a level sufficient to axially drive the mandrel 120 downwardly through a second axial travel increment as indicated by the arrow T3 in FIG. 1C. During this third axial mandrel indexing stroke, as indicated in FIG. 1C, the upper mandrel groove end surface 178 is forced downwardly past the section of the inner plug portion 186 slidably received in the mandrel groove 176. This shears off the groove-received inner end of the plug portion 186, thereby permitting pressurized fluid 196 within the interior of the tubing string 117 and upper adapter 112 to be sequentially forced outwardly through the interior of the plug section 186, the slot 190, the passage 184, and the control line 192 to thereby set the packer (or operate another external pressure-actuatable device to which the control line 192 is operatively connected).

Accordingly, the tubing string 117 may be pressure tested during the first indexing cycle of the mandrel 120 without setting the packer. Thus, if a leak is detected the completion may be easily pulled up for repair without interference from the packer.

As previously described herein, the mandrel 120, as it is downwardly indexed, may itself be used to perform various tool-related operations such as being brought into operative engagement with a disappearing plug structure as illustrated and described in the aforementioned copending application Ser. No. 08/667,305 incorporated herein by reference. It should also be appreciated, however, that the mandrel 120 could also be used to simply prevent the packer from being set during an initial internal pressure test of the tubing string. In this case the upper groove end surface 178 could be positioned to shear off the groove-received end section of the inner plug portion 186 during the second incremental downward indexing movement of the mandrel 120.

Figure 3:
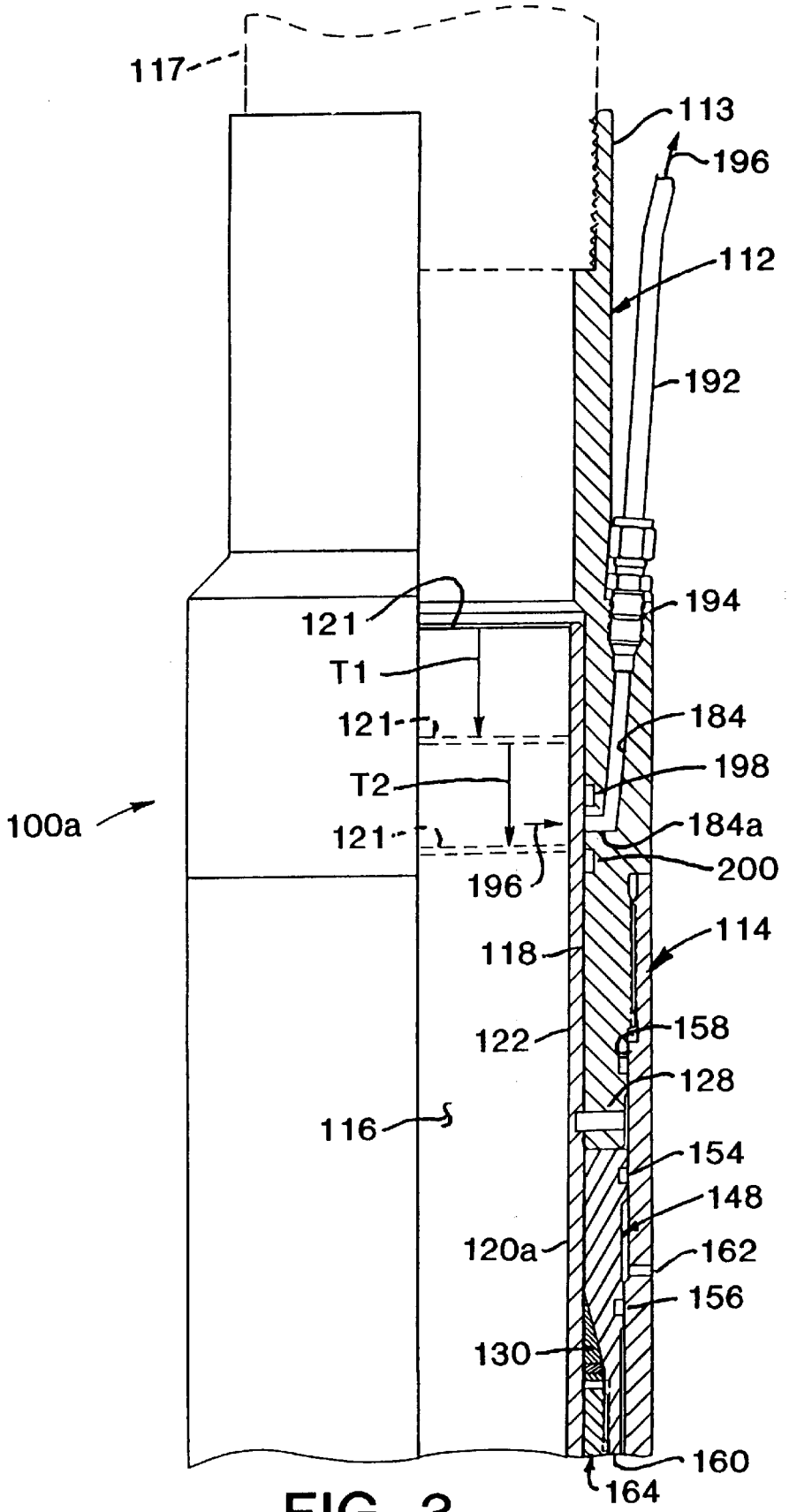
FIG. 3 is a quarter-sectioned view of an upper longitudinal portion of a first alternate embodiment of the linear indexing apparatus.

An upper portion of a first alternate embodiment 100*a* of the linear indexing apparatus 100 is shown in FIG. 3. As illustrated, apparatus 100*a* has a modified pressure diversion portion in that the external side surface groove in the mandrel 120*a* is eliminated as is the previously described plug structure 182 (see FIG. 1). Additionally the adapter side wall port 180 is eliminated and replaced with an inner end portion 184*a* which extends inwardly through the inner side surface of the upper adapter 112 between upper and lower elastomeric O-ring seals 198,200 operatively supported thereon in corresponding recesses.

After the first axial mandrel travel increment T1 the upper end 121 of the mandrel 120*a* is positioned above the seal 198 so that the mandrel itself prevents outward passage of pressurized fluid within the tubing string to set the packer. However, during a subsequent axial mandrel travel increment (representatively the second travel increment T2) the upper mandrel end 121 is moved downwardly past the upper seal 198 to thereby permit pressurized fluid 196 within the tubing string to sequentially flow outwardly through the passage 184*a*,184 and the control line 192 to set the packer. Thus, due to the internal tubing pressure-created axial indexing of the mandrel 120*a* the tubing string 117 may be pressure tested before the internal tubing pressure is communicated with the packer.

Figure 4:
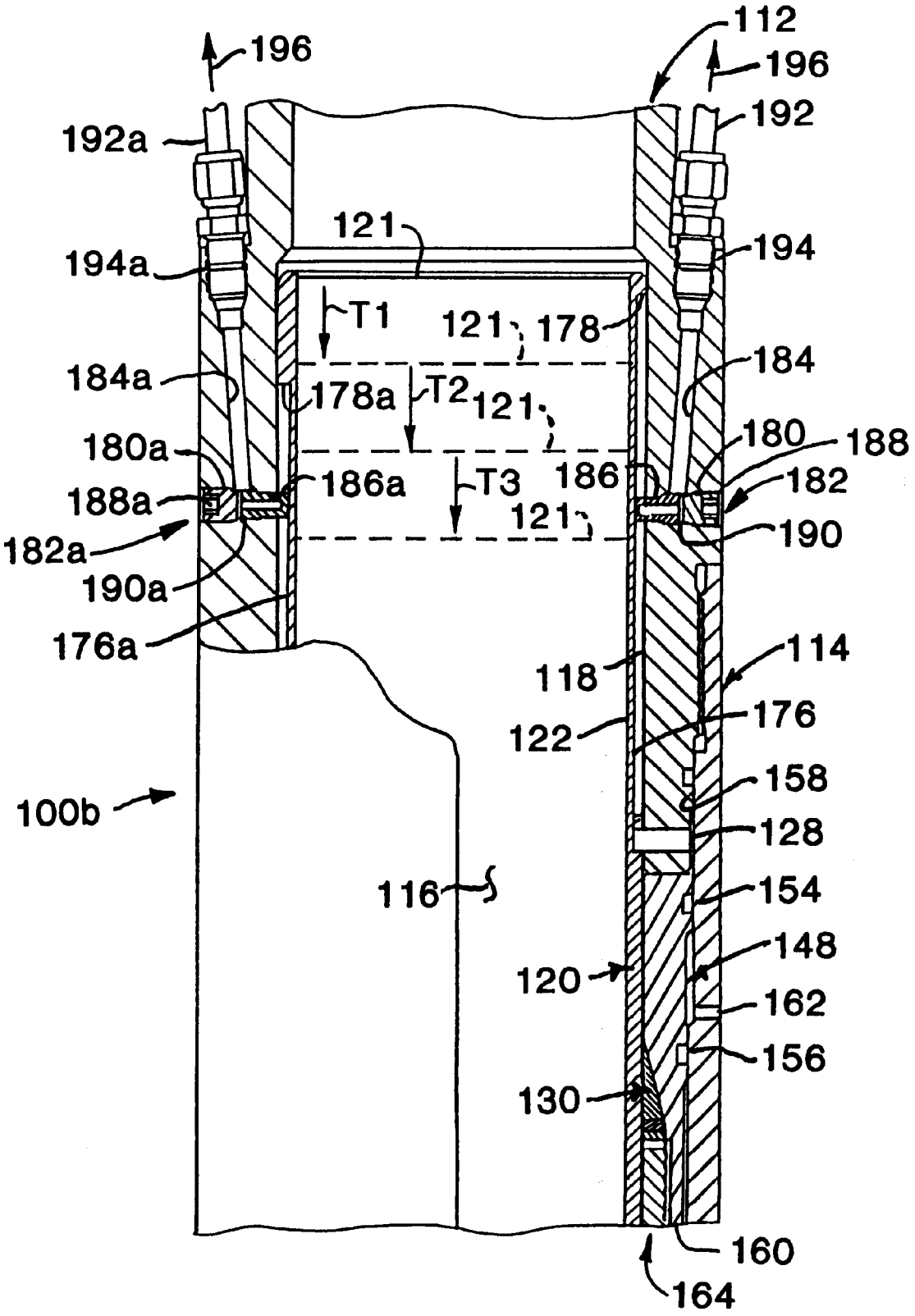
FIG. 4 is partially sectioned side elevational view of an upper longitudinal portion of a second alternate embodiment of the linear indexing apparatus.

A second alternate embodiment 100*b* of the previously described linear indexing apparatus 100 is illustrated in FIG. 4. Apparatus 100*b* is similar to apparatus 100, but is provided with an additional pressure diversion portion that permits the apparatus 100*b* to divert internal tubing pressure through an additional discharge path after a pressure test of the tubing string has been conducted.

This additional pressure diversion portion is positioned in a circumferentially spaced relationship with the previously described pressure diversion portion, representatively in a diametrically opposed relationship therewith. More specifically, the additional pressure diversion portion includes (1) an axially extending exterior side surface groove 176*a* formed in the mandrel 120 directly across from the groove 176 and having an upper end surface 178*a* downwardly offset from the groove end surface 178, (2) a plug structure 182*a* identical to the plug structure 182 and having an inner end section of plug portion 186*a* slidably received in the mandrel groove 176*a*, (3) an adapter passage 184*a* communicating at its inner end with the port 180*a* within the plug structure 182*a* is received, and a control line 192*a* communicated at its inner end with the passage 184*a* and at is outer end with an external pressure-actuatable device (which, like the packer to which the control line 192 is connected, is not illustrated).

After the first downward axial mandrel travel increment T1 (and the corresponding internal tubing pressure test), both of the mandrel groove end surfaces 178,178*a* are positioned above their associated plug structures 182,182*a* which continue to preclude the outward flow of pressurized tubing fluid through their associated ports 180,180*a*.

Upon completion of the subsequent second axial mandrel travel increment T2, the left mandrel upper end surface 178*a* has passed and sheared off the groove-received inner section of the plug portion 186*a*, thereby permitting pressurized interior tubing fluid 196 to flow sequentially outwardly through the port 180*a*, the passage 184*a*, and the left control line 192*a* to thereby actuate the external device to which the control line 192*a* is connected. At the completion of the second axial mandrel travel increment T2 the right upper mandrel groove end surface 178 is still positioned above its associated plug structure 182 which still precludes outward pressurized fluid flow through its associated control line 192.

Finally, upon completion of the third axial mandrel travel increment T3, the upper mandrel groove end surface 178 downwardly passes and shears off the groove-received inner end section of the plug portion 186, thereby permitting outflow of pressurized internal tubing string fluid 196 sequentially through the port 180, the passage 184, and the control line 192 to set the packer to which the control line 192 is operatively connected.

The modified pressure diversion portion of the linear indexing apparatus 100*b* is thus capable, via its mandrel indexing structure, of utilizing internal tubing pressure to sequentially activate two external pressure-actuatable devices after an initial pressure test of the tubing string. By axially aligning the upper mandrel groove end surfaces 178,178*a* these two devices may alternatively be actuated in a simultaneous fashion. Additionally, by adding other circumferentially spaced pressure diversion portions to the apparatus 100*b*, more than two external pressure-actuatable devices may be controlled using internal tubing string pressure if desired. As will be appreciated, instead of axially offsetting the mandrel groove ends 178,178*a* to effect the sequential communication of the interiors of the control lines 192,192*a* with the interior of the tubing string, the groove ends 178,178*a* could be axially aligned and the plug structures 182,182*a* axially offset from one another.

The foregoing detailed description is to be clearly understood as being given by way of illustration and example only, the spirit and scope of the present invention being limited solely by the appended claims.

What is claimed is:

1. A subterranean wellbore tool comprising:

a tubular outer structure;

a control member movably supported in the outer structure;

indexing structure associated with the control member and operative to sequentially drive it through a plurality of predetermined separate travel increments relative to the outer structure in response to a corresponding successive plurality of fluid pressure applications; and pressure diversion apparatus operative to permit flow of pressurized fluid through a side wall portion of the outer structure only after the control member has been driven at least partially through its second or subsequent travel increment.

2. The subterranean wellbore tool of claim 1 wherein:

the control member is a tubular mandrel coaxially and slidably supported within the tubular outer structure.

3. The subterranean wellbore tool of claim 2 wherein:

the travel increments of the tubular mandrel are axially directed relative to the tubular outer structure.

4. The subterranean wellbore tool of claim 3 wherein the pressure diversion apparatus includes:

a passage extending outwardly through the outer structure side wall portion, a frangible hollow plug structure sealingly received in the passage and preventing fluid flow therethrough, the plug structure having an inner end section which projects into the interior of the outer structure and, when broken, permits fluid flow outwardly through the passage, and an axially extending side wall depression formed in the mandrel and slidably receiving the inner plug structure end section, the depression having an end surface positioned to forcibly engage and break the inner plug structure end section when the mandrel has been axially driven at least partially through its second or subsequent travel increment.

5. The subterranean wellbore tool of claim 4 wherein:

the depression is an external side surface groove formed in the mandrel.

6. The subterranean wellbore tool of claim 4 wherein:

the passage includes a sidewall port formed in the outer structure, and an outlet portion extending generally transversely to the port, and the plug structure includes:

a hollow first plug portion sealingly received in a radially inner portion of the port and having a closed radially inner end portion defining the inner plug structure end section, and an open radially outer end, and a second plug portion received in a radially outer portion of the port and having an inner end bearing against the outer end of the first plug portion and retaining the first plug portion sealingly within the radially inner portion of the port, the second plug portion having an opening therein through which the interior of the first plug portion communicates with the passage outlet portion.

7. The subterranean wellbore tool of claim 6 wherein:

the opening in the second plug portion is defined by a transverse slot formed in its inner end.

8. The subterranean wellbore tool of claim 3 wherein the pressure diversion apparatus includes:

a fluid outlet passage formed in the outer structure side wall portion and having an inlet opening on the interior side surface of the outer structure in opposition to an exterior side surface portion of the mandrel, and a seal structure operative to prevent pressurized fluid outflow through the passage until the mandrel has been axially driven at least partially through its second or subsequent travel increment.

9. The subterranean wellbore tool of claim 8 wherein the seal structure includes:

a pair of resilient O-ring seal members carried on the inner side of the outer structure on axially opposite sides of the inlet opening of the fluid outlet passage.

10. A subterranean wellbore tool comprising:

a tubular outer structure having a side wall portion with spaced first and second fluid outlet passages formed therein and opening into the interior of the outer structure;

a control member movably supported in the outer structure;

indexing structure associated with the control member and operative to sequentially drive it through a plurality of predetermined separate travel increments, including a first travel increment, relative to the outer structure in response to a corresponding successive plurality of pressure applications; and pressure diversion apparatus operative to permit flow of pressurized fluid through the first and second fluid outlet passages only after the control member has been driven at least partially through at least one travel increment subsequent to its first travel increment.

11. The subterranean wellbore tool of claim 10 wherein:

the control member is a tubular mandrel coaxially and slidably supported within the tubular outer structure.

12. The subterranean wellbore tool of claim 11 wherein:

the travel increments of the tubular mandrel are axially directed relative to the tubular outer structure.

13. The subterranean wellbore tool of claim 12 wherein the pressure diversion apparatus includes:

first and second hollow plug structures respectively and sealingly received in the first and second fluid outlet passages, each of the first and second plug structures having an inner end section which projects into the interior of the outer structure and, when broken, permits fluid flow outwardly through its associated one of the first and second fluid outlet passages, and spaced apart first and second axially extending side wall depressions formed in the mandrel and slidingly receiving the inner end sections of the first and second plug structures, respectively, each of the first and second depressions having an end surface positioned to forcibly engage and break its associated inner plug structure end section as the end surfaces axially passes it.

14. The subterranean wellbore tool of claim 13 wherein:

each of the first and second axially extending side wall depressions is an external side surface groove formed in the mandrel.

15. The subterranean wellbore tool of claim 13 wherein:

each of the first and second fluid outlet passages includes a sidewall port formed in the outer structure, and an outlet portion extending generally transversely to the port, and each of the first and second plug structures includes:

a hollow first plug portion sealingly received in a radially inner portion of its associated port and having a closed radially inner end portion defining one of the inner plug structure end sections, and an open radially outer end, and a second plug portion received in a radially outer portion of its associated port and having an inner end bearing against the outer end of its associated first plug portion and retaining it sealingly within the radially inner portion of its associated port, the second plug portion having an opening therein through which the interior of its associated first plug portion communicates with the associated passage outlet portion.

16. The subterranean wellbore tool of claim 15 wherein:

the opening in each second plug portion is defined by a transverse slot formed in its inner end.

17. The subterranean wellbore tool of claim 10 wherein:

the first and second fluid outlet passages are circumferentially offset from one another.

18. The subterranean wellbore tool of claim 10 wherein:

the pressure diversion apparatus is operative to sequentially permit pressurized fluid outflow through the first and second fluid outlet passages in response to axial movement of the mandrel through two travel increments subsequent to its first travel increment.

19. The subterranean wellbore tool of claim 13 wherein:

the first and second fluid outlet passages are circumferentially offset from one another, the first and second mandrel depressions are circumferentially offset from one another, and the pressure diversion apparatus is operative to sequentially permit pressurized fluid outflow through the first and second fluid outlet passages in response to axial movement of the mandrel through two travel increments subsequent to its first travel increment.

20. The subterranean wellbore tool of claim 19 wherein:

the end surfaces of the first and second mandrel depressions are axially offset from one another.

21. For use in a tubular structure operatively positionable in a subterranean wellbore and adapted to receive a pressurized fluid from a source thereof, a method of selectively transferring pressurized fluid between the interior and the exterior of the tubular structure, said method comprising the steps of:

forming a side wall opening in the tubular structure;

movably supporting a control member in the tubular structure;

utilizing a successive plurality of pressure applications to sequentially drive the control member through a plurality of predetermined separate travel increments relative to the tubular structure; and permitting pressurized fluid to flow through the side wall opening only after the control member has been driven at least partially through its second or subsequent travel increment.

22. The method of claim 21 wherein:

the control member is a tubular mandrel coaxially and slidably received within the tubular structure, and the utilizing step is performed in a manner such that the travel increments of the mandrel are axially directed relative to the tubular structure.

23. The method of claim 22 wherein the permitting step includes the steps of:

sealingly positioning a hollow frangible plug structure in the side wall opening, and utilizing the mandrel, during axial movement thereof through its second or subsequent travel increment, to break the plug structure.

24. The method of claim 22 wherein the permitting step includes the steps of:

causing the mandrel to sealingly block the side wall opening prior to and during the movement of the mandrel through its first travel increment, and causing the mandrel to unblock the side wall opening in response to movement of the mandrel through its second or subsequent travel increment.

25. For use in a tubular structure operatively positionable in a subterranean wellbore and adapted to receive a pressurized fluid from a source thereof, a method of selectively transferring pressurized fluid between the interior and the exterior of the tubular structure, said method comprising the steps of:

forming spaced apart first and second side wall openings in the tubular structure;

movably supporting a control member in the tubular structure;

utilizing a successive plurality of fluid pressure applications to sequentially drive the control member through a plurality of predetermined separate travel increments relative to the tubular structure; and permitting pressurized fluid within the tubular structure to flow through the first and second side wall openings only after the control member has been driven at least partially through at least one travel increment subsequent to its first travel increment.

26. The method of claim 25 wherein:

the control member is a tubular mandrel coaxially and slidably received within the tubular structure, and the utilizing step is performed in a manner such that the travel increments of the mandrel are axially directed relative to the tubular structure.

27. The method of claim 26 wherein:

the permitting step is performed in a manner sequentially permitting pressurized fluid outflow through the first and second side wall openings.

28. The method of claim 26 wherein the permitting step includes the steps of:

sealingly positioning hollow frangible plug structures in the first and second side wall openings, and utilizing the mandrel, during axial movement thereof subsequent to its first travel increment, to break the plug structures.

29. The method of claim 28 wherein:

the mandrel is utilized, during axial movement thereof subsequent to its first travel increment to sequentially break the plug structures.

* * * * *